US010815993B2

(12) United States Patent
Kitaguchi et al.

(10) Patent No.: US 10,815,993 B2
(45) Date of Patent: Oct. 27, 2020

(54) SCROLL FLUID MACHINE WITH IMPROVED POWER TRANSMISSION MECHANISM

(71) Applicant: MITSUBISHI HEAVY INDUSTRIES, LTD., Tokyo (JP)

(72) Inventors: Keita Kitaguchi, Tokyo (JP); Takahide Ito, Tokyo (JP); Makoto Takeuchi, Tokyo (JP); Takuma Yamashita, Tokyo (JP); Hirofumi Hirata, Tokyo (JP); Kazuhide Watanabe, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 261 days.

(21) Appl. No.: 16/088,628

(22) PCT Filed: Jan. 25, 2017

(86) PCT No.: PCT/JP2017/002605
§ 371 (c)(1),
(2) Date: Sep. 26, 2018

(87) PCT Pub. No.: WO2017/169041
PCT Pub. Date: Oct. 5, 2017

(65) Prior Publication Data

US 2020/0232460 A1 Jul. 23, 2020

(30) Foreign Application Priority Data

Mar. 31, 2016 (JP) ..... 2016-071995

(51) Int. Cl.
*F04C 18/02* (2006.01)
*F01C 17/06* (2006.01)

(52) U.S. Cl.
CPC ..... *F04C 18/023* (2013.01); *F01C 17/063* (2013.01); *F04C 2240/50* (2013.01); *F04C 2240/60* (2013.01)

(58) Field of Classification Search
CPC .. F01C 17/063; F04C 18/023; F04C 2240/30; F04C 2240/50
See application file for complete search history.

(56) References Cited

U.S. PATENT DOCUMENTS

2002/0150485 A1 10/2002 Mori et al.
2002/0182094 A1 12/2002 Mori et al.

FOREIGN PATENT DOCUMENTS

DE 102018107460 A1 * 10/2018 ..... F04C 18/0215
JP 3-990 A 1/1991
(Continued)

OTHER PUBLICATIONS

International Search Report dated Mar. 14, 2017 in International Patent Application No. PCT/JP2017/002605.
(Continued)

*Primary Examiner* — Mary Davis
(74) *Attorney, Agent, or Firm* — Birch, Stewart, Kolasch & Birch, LLP

(57) ABSTRACT

To provide a scroll fluid machine that can improve reliability in abrasion resistance of a power transmission mechanism including a pin member and a ring member. The machine includes a driving scroll member (20), a driven scroll member (22), and a power transmission mechanism (26) that transmits power to synchronously rotate both scroll members (20, 22) and allow the scroll members to revolve and orbit relative to each other. The power transmission mechanism (26) includes a pin (30) attached to the driven scroll member (22), a ring body (34) provided in the driving scroll member (20) and having an inner circumference in contact with an outer circumference of the pin (30), and a circular
(Continued)

groove (32) housing the ring body (34) and having an inner circumference in contact with an outer circumference of the ring body (34). Of surface contact pressure in a contact portion between the outer circumference of the pin (30) and the inner circumference of the ring body (34), and surface contact pressure in a contact portion between the outer circumference of the ring body (34) and the inner circumference of the circular groove (32), the contact portion having higher surface contact pressure has a larger frictional torque.

8 Claims, 6 Drawing Sheets

(56) References Cited

FOREIGN PATENT DOCUMENTS

| | | | |
|---|---|---|---|
| JP | 2002-310073 | A | 10/2002 |
| JP | 2002-357188 | A | 12/2002 |

OTHER PUBLICATIONS

Office Action dated Mar. 14, 2017 in related Japanese Patent Application No. 2016-071995.
Written Opinion dated Mar. 14, 2017 in International Patent Application No. PCT/JP2017/002605.

* cited by examiner

SCROLL FLUID MACHINE WITH IMPROVED POWER TRANSMISSION MECHANISM

TECHNICAL FIELD

The present invention relates to a co-rotating scroll fluid machine in which meshed scroll members rotate in synchronization with each other.

BACKGROUND ART

A co-rotating scroll compressor (scroll fluid machine) in which meshed scroll members rotate in synchronization with each other has been known (see Patent Literature 1, for example). The configuration includes a driving scroll, and a driven scroll that rotates in synchronization with the driving scroll. A driven shaft supporting rotation of the driven scroll is offset from a driving shaft rotating the driving scroll by the turning radius, and the driving shaft and the driven shaft are rotated in the same direction at the same angular velocity and the same phase. This allows the scrolls to turn relative to each other, to achieve the same compression performance as a generally known scroll compressor including a fixed scroll and an orbiting scroll.

Such a co-rotating scroll compressor requires a power transmission mechanism for synchronizing both scroll members and allowing the scroll members to revolve and orbit relative to each other. In Patent Literature 1, a power transmission mechanism is configured of four pin and ring pairs.

CITATION LIST

Patent Literature

[PTL 1] Japanese Unexamined Patent Application, Publication No. 2002-310073

SUMMARY OF INVENTION

Technical Problem

A power transmission mechanism using a pin and a ring as in Patent Literature 1 includes a contact portion between the outer circumference of the pin and the inner circumference of the ring, and a contact portion between the outer circumference of the ring and the inner circumference of a circular groove housing the ring. Sliding (relative sliding) may occur in the contact portions.

The present inventors focused on the risk of degradation in reliability of the power transmission mechanism due to abrasion from sliding in the contact portions. As a result of intensive studies, the inventors have found that one of the contact portions has relatively higher surface contact pressure because of the structure of the power transmission mechanism including a pin and a ring, and sliding of the contact portion having higher surface contact pressure may degrade reliability of the power transmission mechanism.

The present invention has been made in view of the foregoing, and aims to provide a scroll fluid machine that can improve reliability in abrasion resistance of a power transmission mechanism including a pin member and a ring member.

Solution to Problem

To solve the above problem, a scroll fluid machine of the present invention adopts the following solutions.

Specifically, a scroll fluid machine according to an aspect of the present invention includes: a first scroll member that has a spiral first wall body; a second scroll member that has a spiral second wall body meshed with the first wall body to form a compression space; and a power transmission mechanism that transmits power to synchronously rotate both of the scroll members and allow the scroll members to revolve and orbit relative to each other. The power transmission mechanism includes a pin member that is attached to one of the scroll members, a ring member that is provided in the other of the scroll members and has an inner circumference in contact with an outer circumference of the pin member, and a circular groove that is formed in the other of the scroll members to house the ring member, and has an inner circumference in contact with an outer circumference of the ring member. Of surface contact pressure in a contact portion between the outer circumference of the pin member and the inner circumference of the ring member, and surface contact pressure in a contact portion between the outer circumference of the ring member and the inner circumference of the circular groove, the contact portion having higher surface contact pressure has a larger frictional torque.

The first wall body of the first scroll member and the second wall body of the second scroll member are meshed with each other to form a compression chamber, and the first scroll member and the second scroll member are synchronously rotated and allowed to revolve and orbit relative to each other, to form a co-rotating scroll compressor in which the first scroll member and the second scroll member rotate together. The power transmission mechanism that transmits power between the first scroll member and the second scroll member is provided to rotate both the first scroll member and the second scroll member. For example, when rotational force is input into one scroll member from a power source such as a motor, power is transmitted to the other scroll member through the power transmission mechanism, and the other scroll member rotates synchronously. Here, synchronous rotation refers to rotation in the same direction at the same angular velocity and the same phase.

The power transmission mechanism includes a pin member, a ring member, and a circular groove housing the ring member. Power is transmitted between both scroll members through contact between the outer circumference of the pin member and the inner circumference of the ring member, and contact between the outer circumference of the ring member and the inner circumference of the circular groove.

Of surface contact pressure in the contact portion between the outer circumference of the pin member and the inner circumference of the ring member, and surface contact pressure in the contact portion between the outer circumference of the ring member and the inner circumference of the circular groove, the contact portion having higher surface contact pressure has a larger frictional torque. With this, power can be transmitted while allowing rolling contact without relative sliding in the contact portion having higher surface contact pressure, and causing relative sliding in the contact portion having lower surface contact pressure. Accordingly, since the contact portion having higher surface contact pressure can be managed to allow rolling contact without causing relative sliding, reliability in abrasion resistance of the power transmission mechanism can be made more secure than when there is risk of relative sliding in the contact portion having higher surface contact pressure.

Examples of the ring member include an endless ring-shaped ring body and a rolling bearing such as a ball bearing.

Moreover, in a scroll fluid machine according to an aspect of the present invention, the ring member is a rolling bearing, and the contact portion having the higher surface contact pressure has a larger frictional torque than the rolling bearing.

Since frictional torque is larger in the contact portion having higher surface contact pressure than the rolling bearing, it is possible to allow rolling contact without relative sliding in the contact portion having higher surface contact pressure, and also to allow the rolling bearing itself to roll.

Note that frictional torque of the rolling bearing should preferably be kept smaller than in the contact portion between the pin member and the rolling bearing and the contact portion between the circular groove and the rolling bearing, to allow preferential rolling of the rolling bearing itself.

Moreover, in a scroll fluid machine according to an aspect of the present invention, when the ring member is fitted into the circular groove, frictional torque is larger in the contact portion between the outer circumference of the pin member and the inner circumference of the ring member, than in the contact portion between the outer circumference of the ring member and the inner circumference of the circular groove.

When the ring member is fitted into the circular groove, surface contact pressure is higher in the contact portion between the outer circumference of the pin member and the inner circumference of the ring member, than in the contact portion between the outer circumference of the ring member and the inner circumference of the circular groove. Hence, in this case, frictional torque is increased in the contact portion between the outer circumference of the pin member and the inner circumference of the ring member, to allow rolling contact.

Moreover, in a scroll fluid machine according to an aspect of the present invention, when the pin member is fitted into the ring member, frictional torque is larger in the contact portion between the outer circumference of the ring member and the inner circumference of the circular groove, than in the contact portion between the outer circumference of the pin member and the inner circumference of the ring member.

When the pin member is fitted into the ring member, surface contact pressure is higher in the contact portion between the outer circumference of the ring member and the inner circumference of the circular groove, than in the contact portion between the outer circumference of the pin member and the inner circumference of the ring member. Hence, in this case, frictional torque is increased in the contact portion between the outer circumference of the ring member and the inner circumference of the circular groove, to allow rolling contact.

Moreover, in a scroll fluid machine according to an aspect of the present invention, a surface roughness of the contact portion having higher surface contact pressure is set larger than a surface roughness of the contact portion having lower surface contact pressure.

By setting the surface roughness of the contact portion having higher surface contact pressure larger than the surface roughness of the contact portion having lower surface contact pressure, frictional torque can be increased. Note that since the magnitude of surface roughness only needs to be set relatively, the surface roughness of the contact portion having higher surface contact pressure may be increased, or the surface roughness of the contact portion having lower surface contact pressure may be reduced.

Moreover, in a scroll fluid machine according to an aspect of the present invention, a high friction material that sets a larger frictional force than the contact portion having lower surface contact pressure is provided in the contact portion having higher surface contact pressure, and/or a low friction material that sets a smaller frictional force than the contact portion having higher surface contact pressure is provided in the contact portion having lower surface contact pressure.

By providing a high friction material that sets a larger frictional force than the contact portion having lower surface contact pressure in the contact portion having higher surface contact pressure, frictional torque can be increased. Also, by providing a low friction material that sets a smaller frictional force than the contact portion having higher surface contact pressure in the contact portion having lower surface contact pressure, frictional torque can be reduced.

An example of a high friction material is a high polymer material (elastomer) having a slip resistant property and elasticity, and therefore rubber is used, for example.

Examples of a low friction material include materials having slip-increasing property such as DLC (diamond-like carbon) coating, PTFE (polytetrafluoroethylene) coating such as Teflon (registered trademark), molybdenum disulfide coating, and surface microtexture.

The high friction material and low friction material may, for example, be provided by adhering to the base material of the pin member, ring member, and circular groove, or by subjecting the parts to surface treatment.

Moreover, in a scroll fluid machine according to an aspect of the present invention, the high friction material is provided in a part of the contact portion, and/or the low friction material is provided in a part of the contact portion.

By providing a high friction material or a low friction material in a part of the contact portion, contact force can be received not only by the high friction material or low friction material, but also by the base material. Hence, durability of the high friction material or low friction material can be improved.

Additionally, when a material having higher elasticity than the base material is used as the high friction material or low friction material, the high friction material or low friction material can be brought into contact earlier than the base material. This can achieve a damping effect at the time of contact, and can reduce noise and vibration.

Advantageous Effects of Invention

Of a contact portion between a pin member and a ring member and a contact portion between the ring member and a circular groove, the contact portion having higher surface contact pressure is assigned a larger frictional torque to avoid relative sliding. Hence, reliability in abrasion resistance of a power transmission mechanism can be improved.

DESCRIPTION OF EMBODIMENTS

Hereinafter, embodiments of the present invention will be described with reference to the drawings.

First Embodiment

Figure 1:
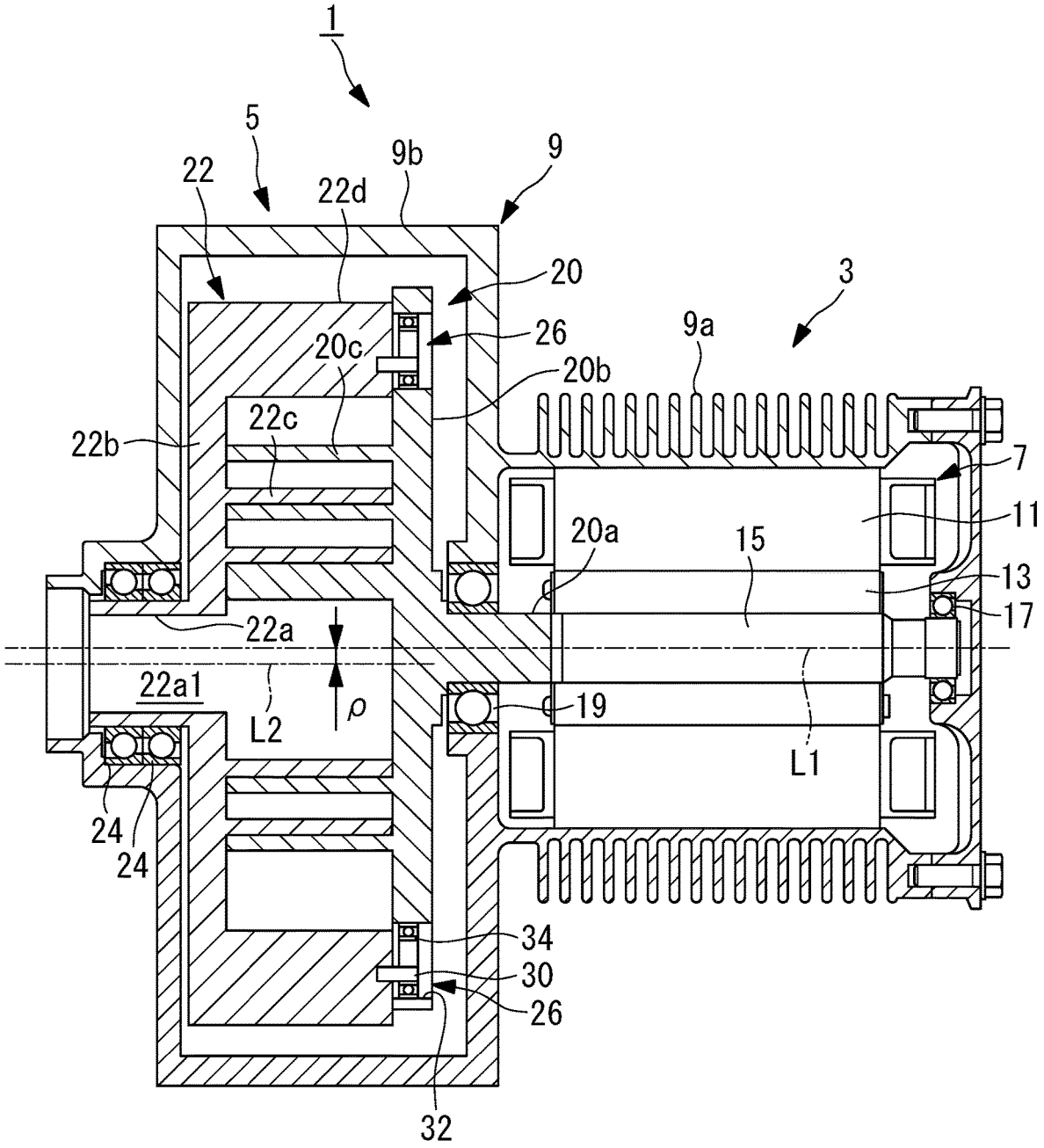
FIG. 1 is a longitudinal section of a scroll compressor of a first embodiment of the present invention.

FIG. 1 is a longitudinal section of a scroll compressor (scroll fluid machine) 1 of a first embodiment of the present invention. As illustrated in FIG. 1, the scroll compressor 1 includes a driving portion 3 and a compression mechanism 5 in a housing 9.

The driving portion 3 includes an electric motor 7 housed in a small diameter portion 9*a* of the housing 9. Radiator fins are provided on the outer circumference of the small diameter portion 9*a* of the housing 9. The electric motor 7 includes a stator 11 fixed to the housing 9 side, and a rotor 13 rotating about a driving-side center axis L1 inside the stator 11. The rotor 13 is fixed to the outer circumference of a rotating shaft 15.

Both ends of the rotating shaft 15 are supported by bearings 17, 19. A shaft portion 20*a* of a driving scroll member 20 is connected to one end (left end in FIG. 1) of the rotating shaft 15. Accordingly, the rotating shaft 15 and the driving scroll member 20 rotate about the same driving-side center axis L1.

The compression mechanism 5 is housed inside a large diameter portion 9*b* of the housing 9, and includes a metal driving scroll member (first scroll member) 20, and a metal driven scroll member (second scroll member) 22.

Figure 2:
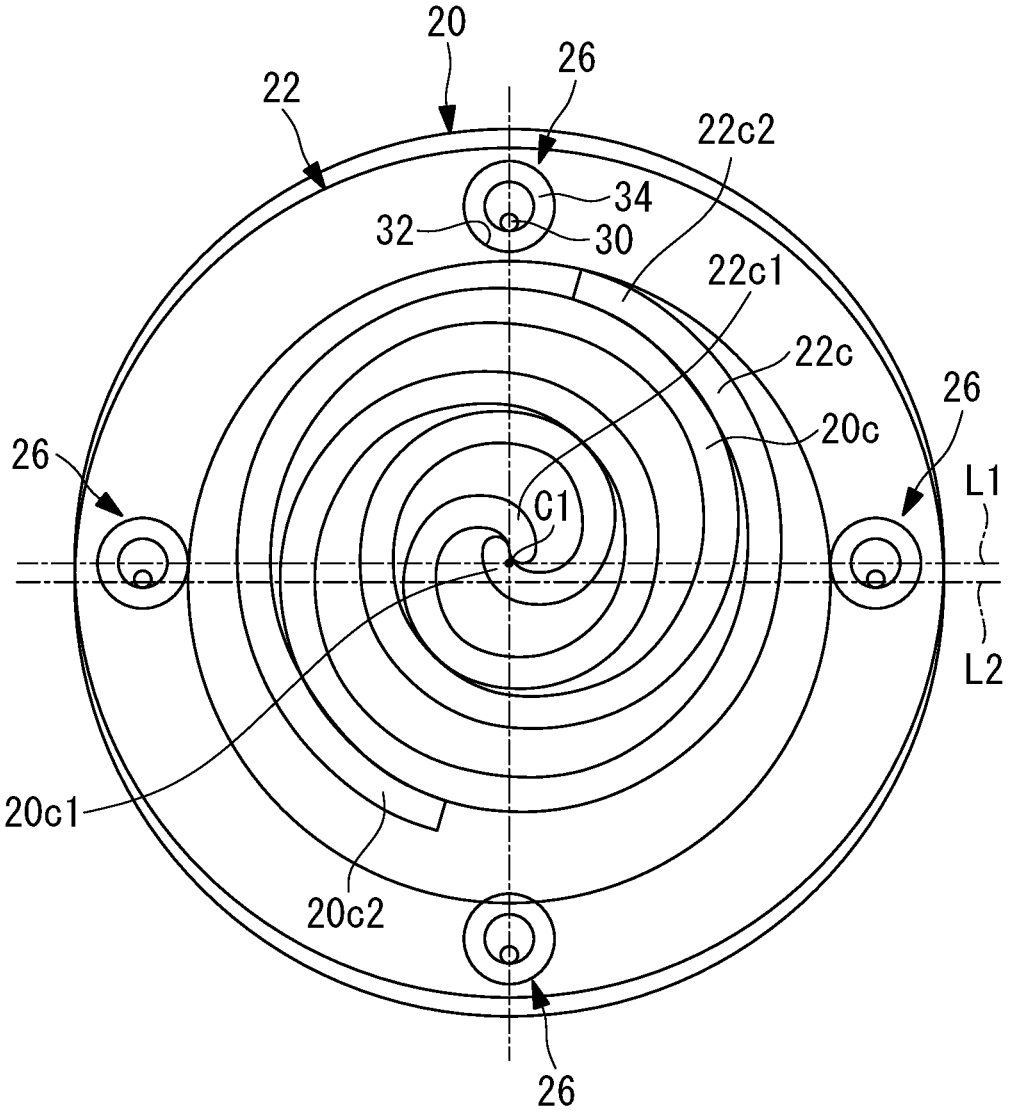
FIG. 2 is a cross section of a scroll member of FIG. 1.

The driving scroll member 20 rotates about the driving-side center axis L1, by a rotational driving force from the rotating shaft 15 transmitted through the shaft portion 20*a*. The driving scroll member 20 includes a disc-shaped end plate 20*b*, and a spiral wall body (first wall body) 20*c* erected substantially vertically on the end plate 20*b*. As illustrated in FIG. 2, the spiral wall body 20*c* is formed into a spiral shape having a winding start portion 20*c*1 on the center side, and a winding end portion 20*c*2 on the outer circumferential side. An inner circumferential face and an outer circumferential face of the spiral wall body 20*c* are formed of an involute curve, for example. Note, however, that the winding start portion 20*c*1 is formed of various curves.

The driven scroll member 22 includes a disc-shaped end plate 22*b*, a spiral wall body (second wall body) 22*c* erected substantially vertically on the end plate 22*b*, and a shaft portion 22*a* provided at the center of the end plate 22*b*.

On the outer circumference of the shaft portion 22*a*, a bearing 24 is attached between the housing 9 and the shaft portion 22*a*. Accordingly, the driven scroll member 22 rotates about a driven-side center axis L2. The driving-side center axis L1 is offset from the driven-side center axis L2 by a predetermined distance p, and the predetermined distance p is the turning radius when the driving scroll member 20 and the driven scroll member 22 revolve and orbit relative to each other.

The shaft portion 22*a* is formed into a cylindrical shape, and a compressed fluid (e.g., air) is discharged through a through hole 22*a*1 formed on the center side of the shaft portion 22*a*.

As illustrated in FIG. 2, the spiral wall body 22*c* is formed into a spiral shape having a winding start portion 22*c*1 on the center side, and a winding end portion 22*c*2 on the outer circumferential side. An inner circumferential face and an outer circumferential face of the spiral wall body 22*c* are formed of an involute curve, for example, so as to mesh with the spiral wall body 20*c* of the driving scroll member 20. Note, however, that the winding start portion 20*c*1 part is formed of various curves.

A power transmission mechanism 26 that transmits power to synchronously rotate both scroll members 20, 22 and allow the scroll members 20, 22 to revolve and orbit relative to each other, is provided between the driving scroll member 20 and the driven scroll member 22. Here, synchronous rotation refers to rotation in the same direction at the same angular velocity and the same phase.

Figure 3:
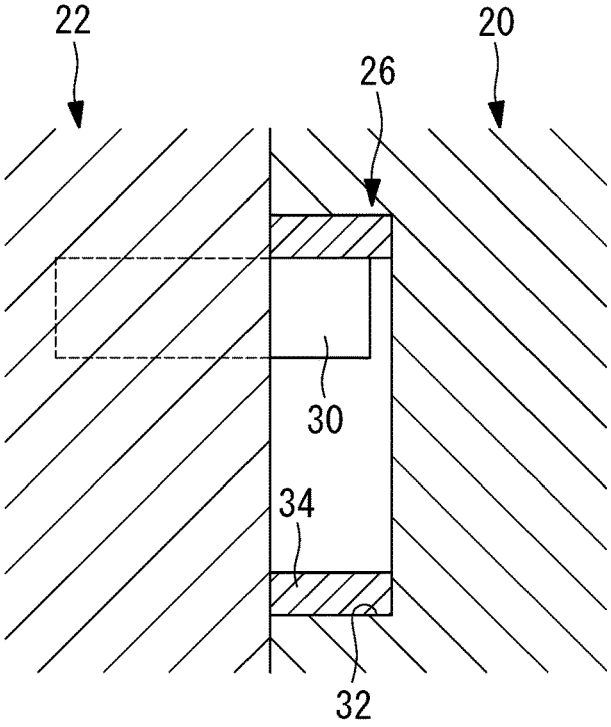
FIG. 3 is a longitudinal section of an enlargement of a power transmission mechanism.

As illustrated in FIG. 1 (in more detail in FIG. 3), the power transmission mechanism 26 includes a pin (pin member) 30 fixed to the driven scroll member 22, a circular groove 32 formed in the end plate 20*b* of the driving scroll member 20, and a ring body (ring member) 34 fitted into the circular groove 32.

The pin 30 is made of metal, and is fixed to an outer circumferential wall portion 22*d* of the driven scroll member 22 facing the end plate 20*b* of the driving scroll member 20. The pin 30 is provided such that one end is embedded in the outer circumferential wall portion 22*d*, and the other end protrudes to the inner circumferential side of the ring body 34.

The circular groove 32 is a circular groove having an inner diameter corresponding to the outer diameter of the ring body 34, and is a hole that penetrates the end plate 20*b* in the embodiment.

The ring body 34 is made of metal, and is formed into an endless ring shape.

As illustrated in FIG. 1, a contact portion is formed between the outer circumference of the pin 30 and the inner circumference of the ring body 34, and a contact portion is formed between the outer circumference of the ring body 34 and the inner circumference of the circular groove 32. Power is transmitted through these contact portions.

As illustrated in FIG. 2, four sets of the pin 30, circular groove 32, and ring body 34 are provided around a center C1 of the driving scroll member 20. Note that although the embodiment includes four sets of the pin 30, circular groove 32, and ring body 34, any number of sets may be provided as long as it is three or more, so six sets may be provided, for example.

The power transmission mechanism 26 described above transmits rotational driving force input into the driving scroll member 20 to the driven scroll member 22.

In the embodiment, frictional torque in the contact portion between the outer circumference of the pin 30 and the inner circumference of the ring body 34 is set larger than frictional torque in the contact portion between the outer circumference of the ring body 34 and the inner circumference of the circular groove 32. Specifically, the surface roughness in the contact portion between the outer circumference of the pin 30 and the inner circumference of the ring body 34 is set larger than the surface roughness in the contact portion between the outer circumference of the pin 30 and the inner circumference of the ring body 34. The surface roughness can be increased by roughening the outer circumference of the pin 30 and the inner circumference of the ring body 34 with a file, a blasting treatment, or the like. The surface roughness may be reduced by smoothening the outer circumference of the ring body 34 and the inner circumference of the circular groove 32 by grinding or the like.

The scroll compressor 1 having the above configuration operates in the following manner.

The electric motor 7 is driven by electric power supplied from an unillustrated power source, and rotation of the rotor 13 rotates the rotating shaft 15 about the driving-side center axis L1. Rotational driving force of the rotating shaft 15 is transmitted to the driving scroll member 20 via a shaft portion 20*a*, and rotates the driving scroll member 20 about the driving-side center axis L1. Rotational force of the driving scroll member 20 is transmitted to the driven scroll member 22 by the power transmission mechanism 26. At this time, rotation of the pin 30 of the power transmission mechanism 26 while abutting on the inner circumference of the ring body 34 allows the driving scroll member 20 and the driven scroll member 22 to revolve and orbit relative to each other.

When the driving scroll member 20 and the driven scroll member 22 revolve and orbit relative to each other, compressed air formed between the spiral wall body 20*c* of the driving scroll member 20 and the spiral wall body 22*c* of the driven scroll member 22 is gradually reduced while moving from the outer circumferential side to the center side, and the fluid sucked in from the outer circumferential side of the scroll members 20, 22 is compressed. The compressed fluid is discharged to the outside from the through hole 22*a*1 formed in the shaft portion 22*a* of the driven scroll member 22.

The embodiment has the following effects.

Frictional torque in the contact portion between the outer circumference of the pin 30 and the inner circumference of the ring body 34 is set larger than frictional force in the contact portion between the outer circumference of the ring body 34 and the inner circumference of the circular groove 32. Hence, power can be transmitted while allowing rolling contact without relative sliding in the interface between the outer circumference of the pin 30 and the inner circumference of the ring body 34, which is the contact portion having higher surface contact pressure, and causing relative sliding between the outer circumference of the ring body 34 and the inner circumference of the circular groove 32, which is the contact portion having lower surface contact pressure. Accordingly, since the contact portion having higher surface contact pressure can be managed to allow rolling contact without causing relative sliding, reliability in abrasion resistance of the power transmission mechanism 26 can be made more secure than when there is risk of relative sliding in the contact portion having higher surface contact pressure.

(Modification 1-1)

Figure 4:
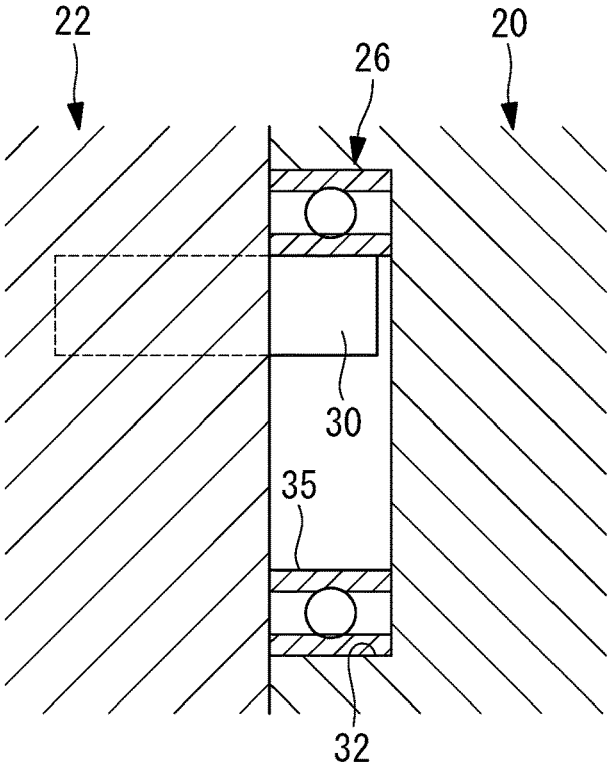
FIG. 4 is a longitudinal section of Modification 1-1.

As a modification of the embodiment, as illustrated in FIG. 4, a ball bearing (rolling bearing) 35 may be provided instead of the ring body 34. In the case of the ball bearing 35, too, the surface roughness is adjusted such that frictional torque in the contact portion between the outer circumference of a pin 30 and the inner circumference of an inner ring of the ball bearing 35 is set larger than frictional torque in the contact portion between the outer circumference of an outer ring of the ball bearing 35 and the inner circumference of a circular groove 32. Then, frictional torque of the ball bearing 35 is set smaller than frictional torque in the contact portion between the outer circumference of the pin 30 and the inner circumference of the inner ring of the ball bearing 35. This has a similar effect as the above embodiment. In particular, if the fit between the outer ring of the ball bearing 35 and the circular groove 32 is tight and does not allow relative sliding, the ball bearing 35 itself rolls, so that there is no sliding contact between the outer circumference of the outer ring of the ball bearing 35 and the inner circumference of the circular groove 32. Hence, reliability is improved even more. Additionally, even if the fit between the outer ring of the ball bearing 35 and the circular groove 32 is loose and allows relative sliding, sliding contact between the outer circumference of the outer ring of the ball bearing 35 and the inner circumference of the circular groove 32 is reduced. Hence, reliability in abrasion resistance is improved even more.

(Modification 1-2)

As a modification of the embodiment, instead of adjusting the surface roughness of the contact portions, the contact portion having higher surface contact pressure may adopt a high friction material having a higher frictional force than the contact portion having lower surface contact pressure. This increases frictional torque of the contact portion having higher surface contact pressure. An example of a high friction material is a high polymer material (elastomer) having a slip resistant property and elasticity, and therefore rubber is used, for example.

Moreover, the contact portion having lower surface contact pressure may adopt a low friction material having a lower frictional force than the contact portion having higher surface contact pressure. This reduces frictional torque of the contact portion having lower surface contact pressure. Examples of a low friction material include materials having slip-increasing property such as DLC (diamond-like carbon) coating, PTFE (polytetrafluoroethylene) coating such as Teflon (registered trademark), molybdenum disulfide coating, and surface microtexture.

The high friction material and low friction material may be provided by adhering to the base material of the pin member, ring member, and circular groove, or by subjecting the parts to surface treatment.

(Modification 1-3)

Figure 5:
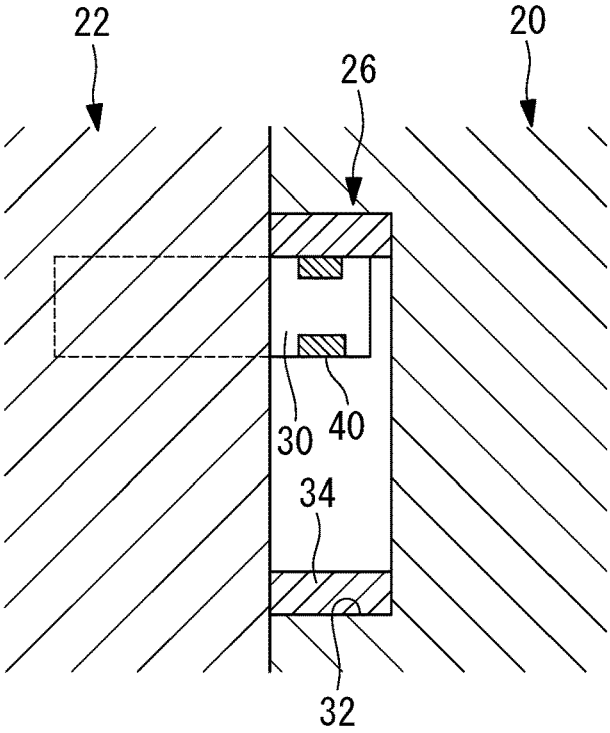
FIG. 5 is a longitudinal section of Modification 1-3.

As a modification of the embodiment, as illustrated in FIG. 5, a high friction material 40 may be provided in a part of the contact portion between the outer circumference of a pin 30 and the inner circumference of a ring body 34. With this, contact force can be received not only by the high friction material 40, but also by the base material of the pin 30. Hence, durability of the high friction material 40 can be improved. It is preferable that the outer diameter of the high friction material 40 is set larger than the outer diameter of the pin 30, to bring the high friction material 40 into contact with the ring body 34 earlier than the base material of the pin 30. This can achieve a damping effect at the time of contact, and can reduce noise and vibration.

Note that the high friction material may be provided on the side of the inner circumference of the ring body 34 to form a part of the contact portion.

Additionally, although not shown in the drawings, a low friction material may be provided on the outer circumference of the ring body 34 or the inner circumference of the circular groove 32 to form a part of the contact portion.

(Modification 1-4)

Figure 6:
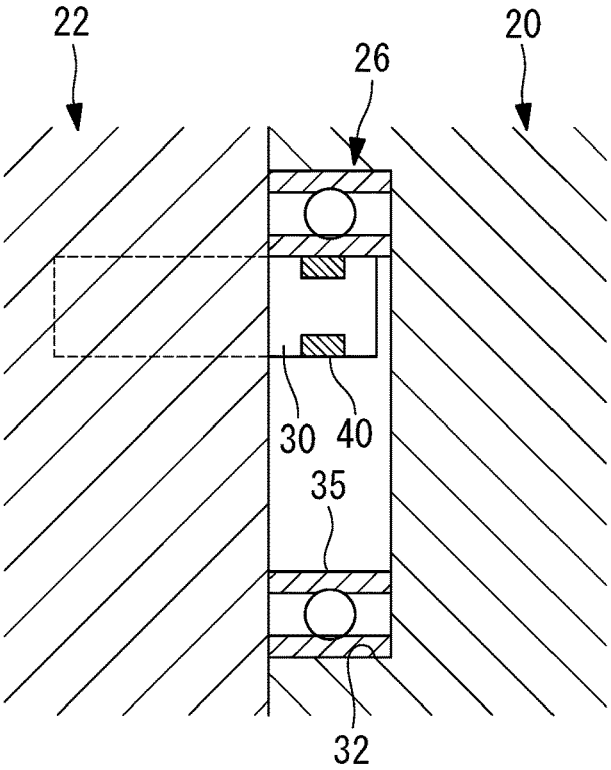
FIG. 6 is a longitudinal section of Modification 1-4.

As a modification of Modification 1-3 described above, as illustrated in FIG. 6, a ball bearing (rolling bearing) 35 may be provided instead of the ring body 34. The effect of providing the ball bearing 35 instead of the ring body 34 is the same as the description of aforementioned Modification 1-1.

Second Embodiment

Next, a second embodiment of the present invention will be described with reference to FIG. 7. In the following description, only points different from the aforementioned first embodiment and its modifications will be described. Accordingly, descriptions of matters common to the first embodiment and its modifications will be omitted.

Figure 7:
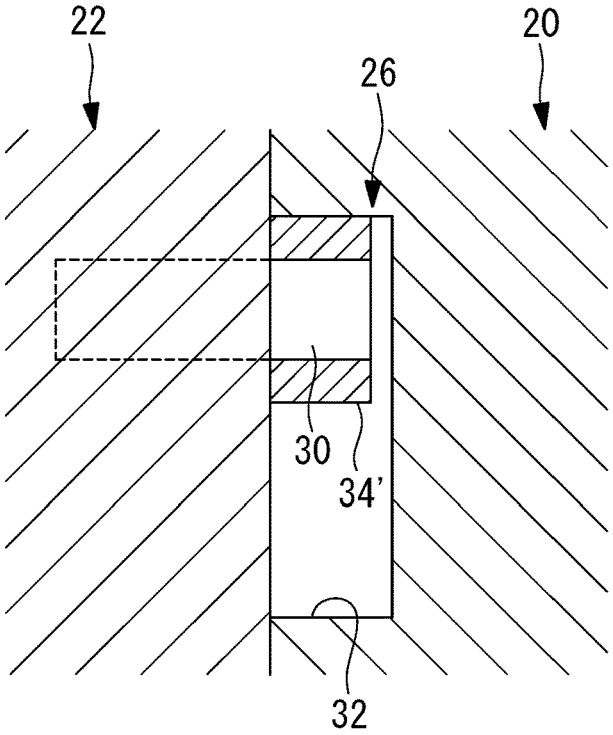
FIG. 7 is a longitudinal section of a second embodiment of the present invention.

As illustrated in FIG. 7, the tip end of a pin 30 is inserted and fitted into the inner circumference of a ring body 34'. In such a configuration, surface contact pressure is higher in the contact portion between the outer circumference of the ring body 34' and the inner circumference of a circular groove 32 than the contact portion between the outer circumference of the pin 30 and the inner circumference of the ring body 34'. Accordingly, frictional torque is set larger in the contact portion between the outer circumference of the ring body 34' and the inner circumference of the circular groove 32 than the contact portion between the outer circumference of the pin 30 and the inner circumference of the ring body 34'.

With this, power can be transmitted while allowing rolling contact without relative sliding in the interface between the outer circumference of the ring body 34' and the inner circumference of the circular groove 32, which is the contact portion having higher surface contact pressure, and causing relative sliding between the outer circumference of the pin 30 and the inner circumference of the ring body 34', which is the contact portion having lower surface contact pressure. Accordingly, since the contact portion having higher surface contact pressure can be managed to allow rolling contact without causing relative sliding, reliability in abrasion resistance of the power transmission mechanism 26 can be made more secure than when there is risk of relative sliding in the contact portion having higher surface contact pressure.

(Modification 2-1)

Figure 8:
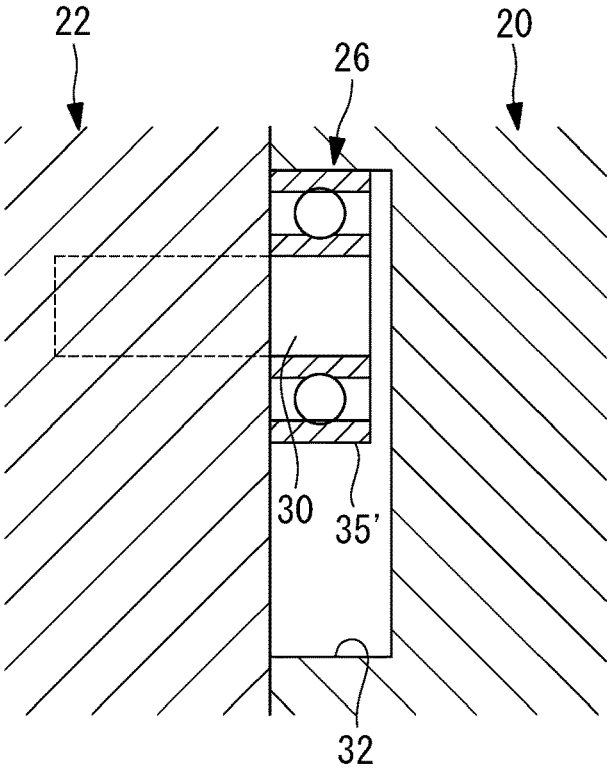
FIG. 8 is a longitudinal section of Modification 2-1.

As a modification of the embodiment, as illustrated in FIG. 8, a ball bearing (rolling bearing) 35' may be provided instead of the ring body 34'. In the case of the ball bearing 35', too, the surface roughness is adjusted such that frictional torque in the contact portion between the outer circumference of an outer ring of the ball bearing 35' and the inner circumference of a circular groove 32 is set larger than frictional torque in the contact portion between the outer circumference of a pin 30 and the inner circumference of an inner ring of the ball bearing 35'. Then, frictional torque of the ball bearing 35' is set smaller than frictional torque in the contact portion between the outer circumference of the outer ring of the ball bearing 35 and the inner circumference of the circular groove 32. This has a similar effect as the above embodiments. In particular, if the fit between the inner ring of the ball bearing 35' and the outer circumference of the pin 30 is tight and does not allow relative sliding, the ball bearing 35 itself rolls, so that there is no sliding contact between the inner circumference of the inner ring of the ball bearing 35' and the outer circumference of the pin 30. Hence, reliability in abrasion resistance is improved even more. Additionally, even if the fit between inner ring of the ball bearing 35' and the outer circumference of the pin 30 is loose and allows relative sliding, sliding contact between the inner ring of the ball bearing 35' and the outer circumference of the pin 30 is reduced. Hence, reliability in abrasion resistance is improved even more.

(Modification 2-2)

As a modification of the embodiment, instead of adjusting the surface roughness of the contact portions, the contact portion having higher surface contact pressure may adopt a high friction material having a higher frictional force than the contact portion having lower surface contact pressure. This increases frictional torque of the contact portion having higher surface contact pressure. An example of a high friction material is a high polymer material (elastomer) having a slip resistant property and elasticity, and therefore rubber is used, for example.

Moreover, the contact portion having lower surface contact pressure may adopt a low friction material having a lower frictional force than the contact portion having higher surface contact pressure. This reduces frictional torque of the contact portion having lower surface contact pressure. Examples of a low friction material include materials having slip-increasing property such as DLC (diamond-like carbon) coating, PTFE (polytetrafluoroethylene) coating such as Teflon (registered trademark), molybdenum disulfide coating, and surface microtexture.

The high friction material and low friction material may be provided by adhering to the base material of the pin member, ring member, and circular groove, or by subjecting the parts to surface treatment.

(Modification 2-3)

Figure 9:
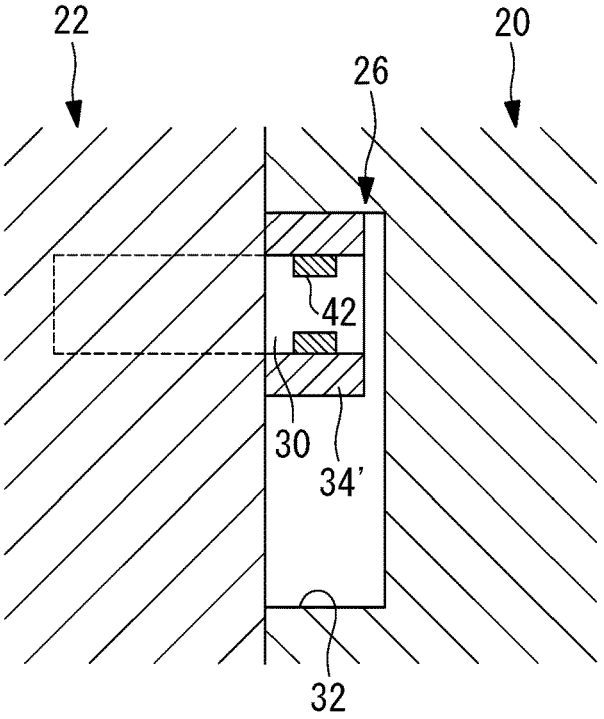
FIG. 9 is a longitudinal section of Modification 2-3.

As a modification of the embodiment, as illustrated in FIG. 9, a low friction material 42 may be provided in a part of the contact portion between the outer circumference of a pin 30 and the inner circumference of a ring body 34'. With this, contact force can be received not only by the low friction material 42, but also by the base material of the pin 30. Hence, durability of the low friction material 42 can be improved. If the low friction material 42 has elasticity, it is preferable that the outer diameter of the low friction material 42 is set larger than the outer diameter of the pin 30, to bring the low friction material 42 into contact with the ring body 34' earlier than the base material of the pin 30. This can achieve a damping effect at the time of contact, and can reduce noise and vibration.

Note that the low friction material may be provided on the side of the inner circumference of the ring body 34' to form a part of the contact portion.

Additionally, although not shown in the drawings, a high friction material may be provided on the outer circumference of the ring body 34' or the inner circumference of the circular groove 32 to form a part of the contact portion.

(Modification 2-4)

As a modification of Modification 2-3 described above, as illustrated in FIG. 10, a ball bearing (rolling bearing) 35' may be provided instead of the ring body 34'. The effect of providing the ball bearing 35' instead of the ring body 34' is the same as the description of aforementioned Modification 2-1.

Figure 10:
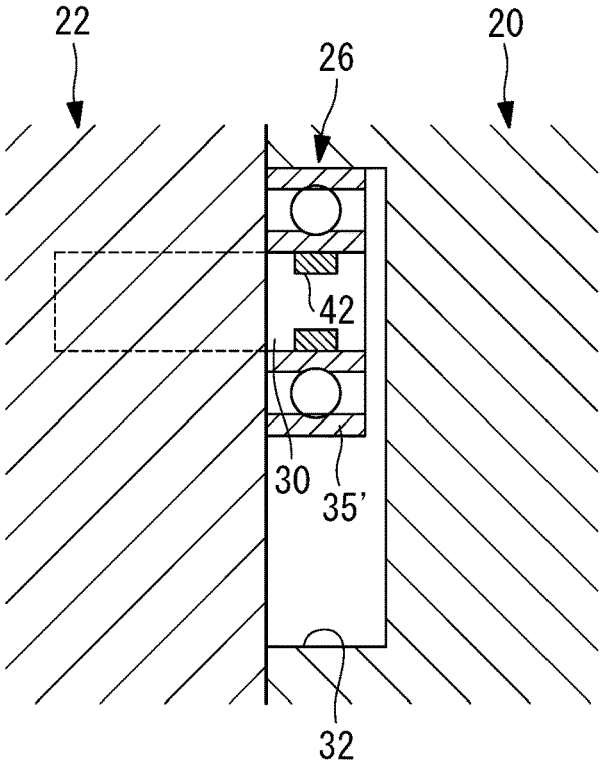
FIG. 10 is a longitudinal section of Modification 2-4.

Note that instead of the low friction material 42 of FIG. 10, a high friction material may be provided on the outer circumference of the outer ring of the ball bearing 35' or the inner circumference of the circular groove 32, to form a part of the contact portion.

Note that although the above embodiments have been described as a compressor, the present invention is not limited to this, and is also applicable to a supercharger, an air brake (air operated braking system), an air compressor, a vacuum pump, and the like.

Also, while the above embodiments use surface roughness and high friction materials to increase frictional torque, the contact portions may be formed into gear shapes meshing with each other.

Moreover, while the pin 30 is attached to the driven scroll member 22 and the ring body 34, 34' or ball bearing 35, 35' is attached to the driving scroll member 20 in the structure of the above embodiments, a reversed relationship may be adopted, that is, the pin 30 may be attached to the driving scroll member 20, and the ring body 34, 34' or the ball bearing 35, 35' may be attached to the driven scroll member 22.

Moreover, any structure may be adopted as long as the power transmission mechanism 26 such as the pin 30, ring body 34, 34', and ball bearing 35, 35' is provided in a member transmitting power between the driving scroll member 20 and the driven scroll member 22. Hence, the power transmission mechanism 26 does not necessarily have to be provided directly on the driving scroll member 20 and the driven scroll member 22.

REFERENCE SIGNS LIST

1 scroll compressor
3 driving portion
5 compression mechanism
7 electric motor
9 housing
11 stator
13 rotor
15 rotating shaft
17 bearing
19 bearing
20 driving scroll member (first scroll member)
20*a* shaft portion
20*b* end plate
20*c* spiral wall body (first wall body)
20*c*1 winding start portion
20*c*2 winding end portion
22 driven scroll member (second scroll member)
22*a* shaft portion
22*b* end plate
22*c* spiral wall body (second wall body)
22*c*1 winding start portion
22*c*2 winding end portion
24 bearing
26 power transmission mechanism
30 pin (pin member)
32 circular groove
34 ring body (ring member)
35 ball bearing (rolling bearing)
40 high friction material
42 low friction material
L1 driving-side center axis
L2 driven-side center axis

The invention claimed is:

1. A scroll fluid machine comprising:
a first scroll member that has a spiral first wall body;
a second scroll member that has a spiral second wall body meshed with the first wall body to form a compression space; and
a power transmission mechanism that transmits power to synchronously rotate both of the scroll members and allow the scroll members to revolve and orbit relative to each other, wherein:
the power transmission mechanism includes
a pin member that is attached to one of the scroll members,
a ring member that is provided in the other of the scroll members and has an inner circumference in contact with an outer circumference of the pin member, and
a circular groove that is formed in the other of the scroll members to house the ring member, and has an inner circumference in contact with an outer circumference of the ring member;
of surface contact pressure in a contact portion between the outer circumference of the pin member and the inner circumference of the ring member, and surface contact pressure in a contact portion between the outer circumference of the ring member and the inner circumference of the circular groove, a larger frictional torque is set in the contact portion having higher surface contact pressure; and
when the ring member is fitted into the circular groove, frictional torque is larger in the contact portion between the outer circumference of the pin member and the inner circumference of the ring member, than in the contact portion between the outer circumference of the ring member and the inner circumference of the circular groove.

2. The scroll fluid machine according to claim 1, wherein:
the ring member is a rolling bearing; and
the contact portion having the higher surface contact pressure has a larger frictional torque than the rolling bearing.

3. The scroll fluid machine according to claim 1, wherein
a surface roughness of the contact portion having higher surface contact pressure is set larger than a surface roughness of the contact portion having lower surface contact pressure.

4. The scroll fluid machine according to claim 1, wherein
a high friction material that sets a larger frictional force than the contact portion having lower surface contact pressure is provided in the contact portion having higher surface contact pressure, and/or a low friction material that sets a smaller frictional force than the contact portion having higher surface contact pressure is provided in the contact portion having lower surface contact pressure.

5. The scroll fluid machine according to claim 4, wherein
the high friction material is provided in a part of the contact portion, and/or the low friction material is provided in a part of the contact portion.

6. A scroll fluid machine comprising:
a first scroll member that has a spiral first wall body;
a second scroll member that has a spiral second wall body meshed with the first wall body to form a compression space; and
a power transmission mechanism that transmits power to synchronously rotate both of the scroll members and allow the scroll members to revolve and orbit relative to each other, wherein:
the power transmission mechanism includes
a pin member that is attached to one of the scroll members,
a ring member that is provided in the other of the scroll members and has an inner circumference in contact with an outer circumference of the pin member, and
a circular groove that is formed in the other of the scroll members to house the ring member, and has an inner circumference in contact with an outer circumference of the ring member;
of surface contact pressure in a contact portion between the outer circumference of the pin member and the inner circumference of the ring member, and surface contact pressure in a contact portion between the outer circumference of the ring member and the inner circumference of the circular groove, a larger frictional torque is set in the contact portion having higher surface contact pressure; and
a surface roughness of the contact portion having higher surface contact pressure is set larger than a surface roughness of the contact portion having lower surface contact pressure.

7. The scroll fluid machine according to claim 6, wherein:
the ring member is a rolling bearing; and
the contact portion having the higher surface contact pressure has a larger frictional torque than the rolling bearing.

8. The scroll fluid machine according to claim 6, wherein when the pin member is fitted into the ring member, frictional torque is larger in the contact portion between the outer circumference of the ring member and the inner circumference of the circular groove, than in the contact portion between the outer circumference of the pin member and the inner circumference of the ring member.

* * * * *